US010898744B2

(12) United States Patent
Baek

(10) Patent No.: US 10,898,744 B2
(45) Date of Patent: Jan. 26, 2021

(54) AUTOMATIC FIRE EXTINGUISHING SYSTEM FOR SMALL SPACES USING FIRE EXTINGUISHING AGENTS

(71) Applicant: Chang Sun Baek, Seoul (KR)

(72) Inventor: Chang Sun Baek, Seoul (KR)

( * ) Notice: Subject to any disclaimer, the term of this patent is extended or adjusted under 35 U.S.C. 154(b) by 0 days.

(21) Appl. No.: 16/107,880

(22) Filed: Aug. 21, 2018

(65) Prior Publication Data

US 2020/0047015 A1 Feb. 13, 2020

(30) Foreign Application Priority Data

Aug. 30, 2017 (KR) ..... 10-2017-0110421

(51) Int. Cl.

| | |
|---|---|
| ***A62C 35/10*** | (2006.01) |
| ***A62C 13/62*** | (2006.01) |
| ***A62C 13/00*** | (2006.01) |
| ***A62C 31/22*** | (2006.01) |

(52) U.S. Cl.

CPC ..... *A62C 35/10* (2013.01); *A62C 13/00* (2013.01); *A62C 13/62* (2013.01); *A62C 31/22* (2013.01)

(58) Field of Classification Search

CPC ..... A62C 35/10; A62C 13/62; A62C 13/64; A62C 13/00; A62C 31/22; B65D 83/382; A61M 5/3286

USPC ... 169/DIG. 3, 9, 30, 26, 38, 42, 71, 74, 81, 169/83; 222/5, 54, 583; 239/272

See application file for complete search history.

(56) References Cited

U.S. PATENT DOCUMENTS

| | | | | |
|---|---|---|---|---|
| 5,551,517 | A * | 9/1996 | Arsenault | A62C 37/12 169/26 |
| 6,112,821 | A * | 9/2000 | Yokoi | A62C 37/12 169/37 |
| 2015/0129246 | A1* | 5/2015 | Kronebusch | A62C 13/76 169/46 |
| 2016/0136471 | A1* | 5/2016 | Groen | A62C 37/40 169/61 |
| 2017/0001050 | A1* | 1/2017 | Kronebusch | A62C 13/64 |
| 2017/0036048 | A1* | 2/2017 | Klug | A62C 37/11 |
| 2017/0042567 | A1* | 2/2017 | Begg | A61B 17/3417 |

* cited by examiner

*Primary Examiner* — Steven J Ganey

(57) ABSTRACT

An automatic fire extinguishing system has a tank that contains fire extinguishing agents, and a housing. The housing has a glass bulb retained therein where the glass bulb is exposed by a side connecting hole, and contacted by a moving member that is biased by an elastic body against the glass bulb. When heat is transferred via the side connecting hole to the glass bulb to break the glass bulb, the elastic body biases the moving member to cause the guiding bars to push a striking member so that a striking protrusion on the striking member breaks a membrane that covers the opening of the tank, thereby allowing the pressurized fire extinguishing agents to escape.

7 Claims, 16 Drawing Sheets

[FIG 1]
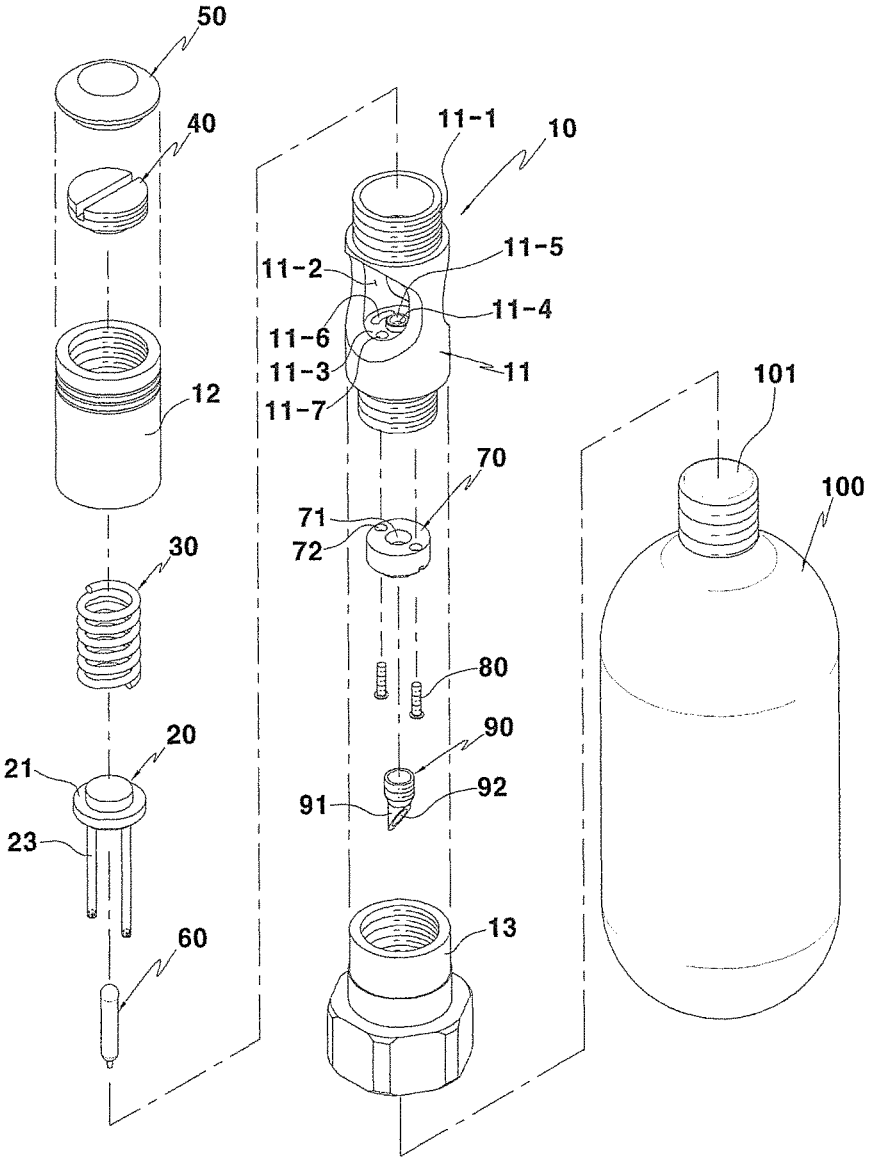

[FIG 2]
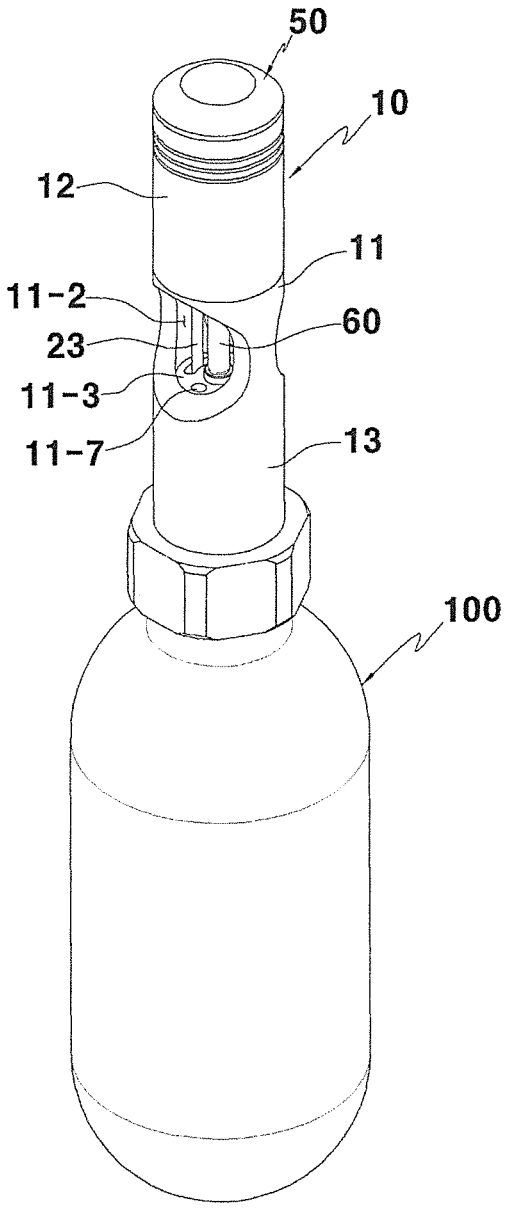

[FIG 3]
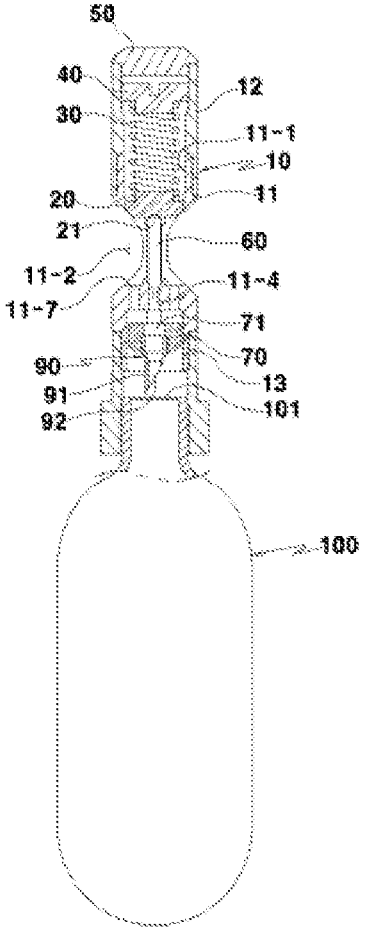

[FIG 4]
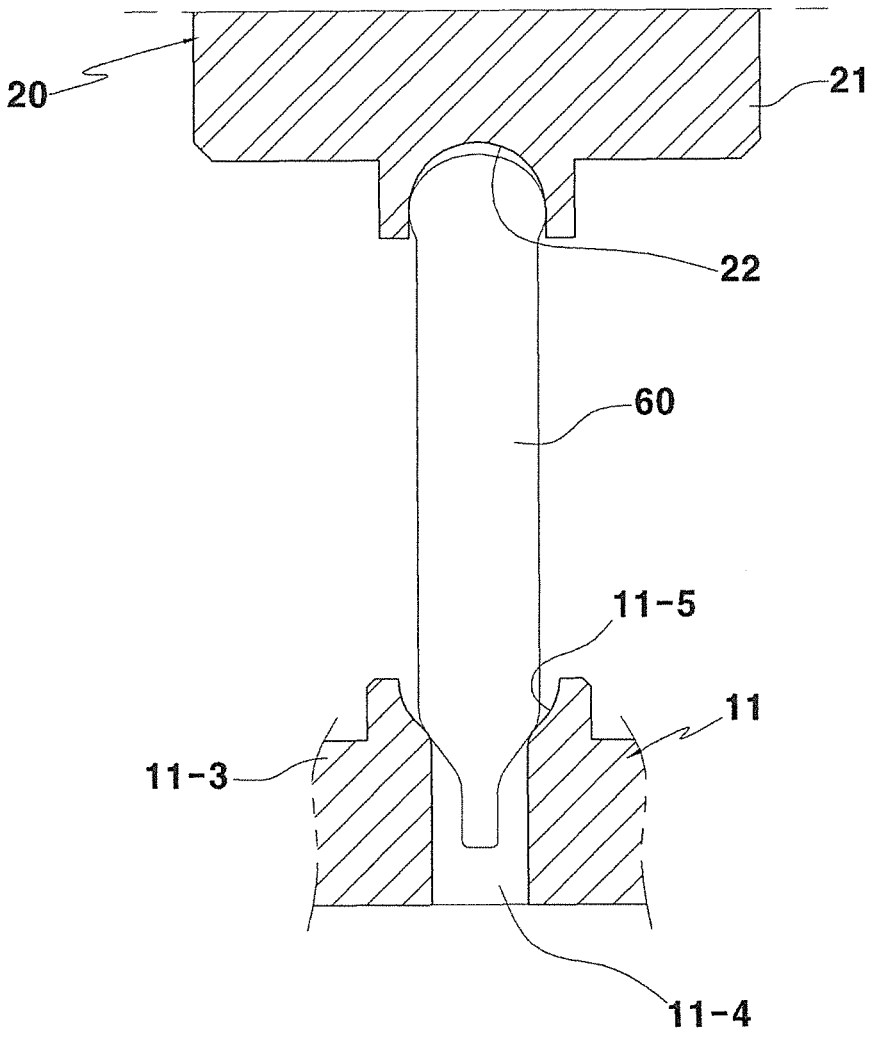

[FIG 5]
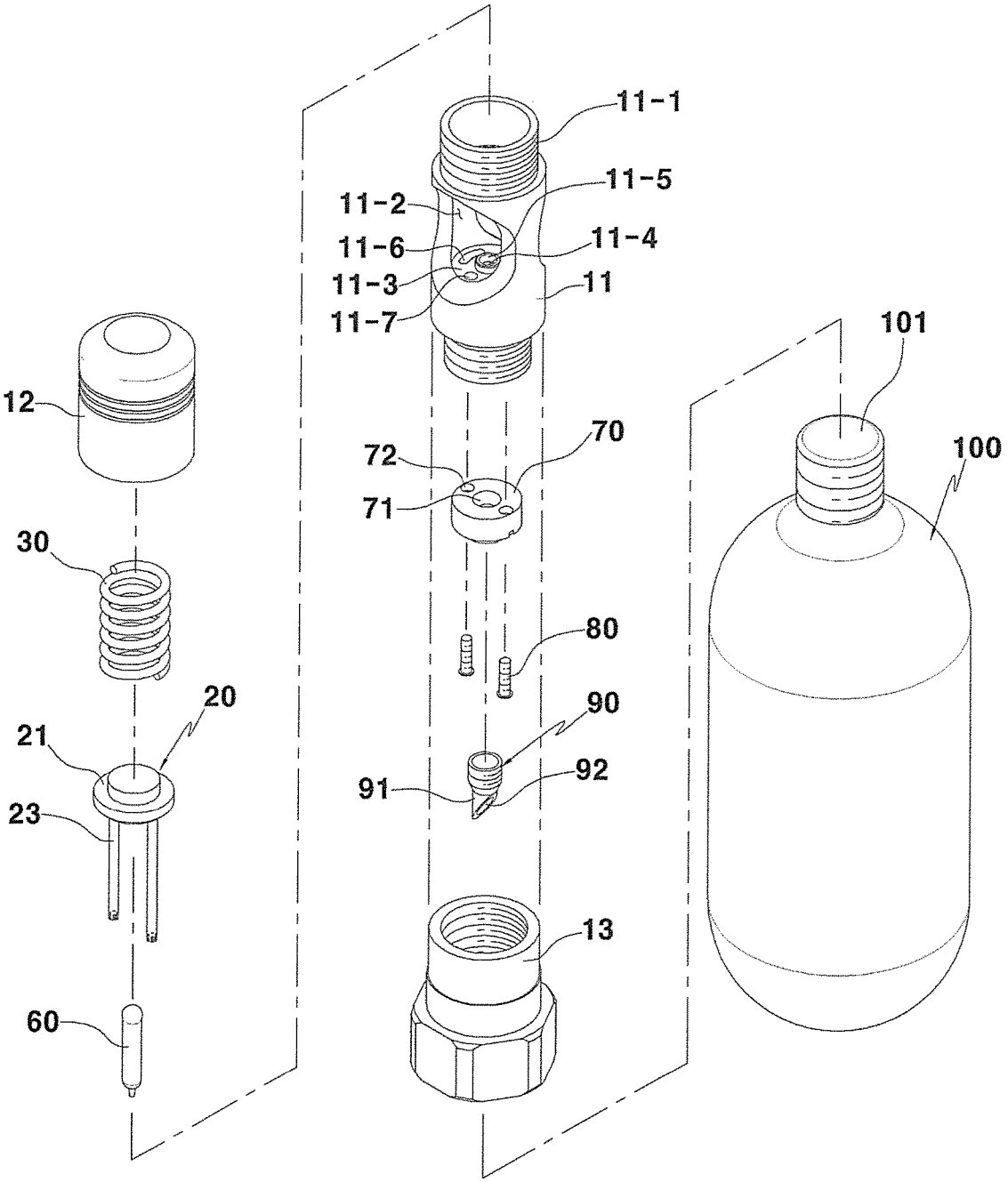

[FIG 6]
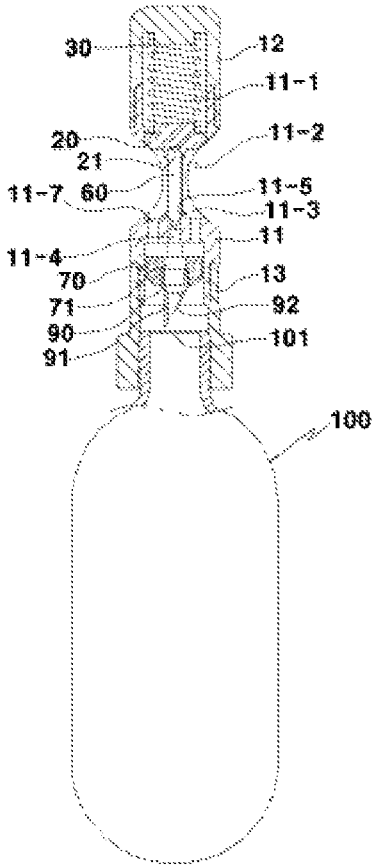

[FIG 7]
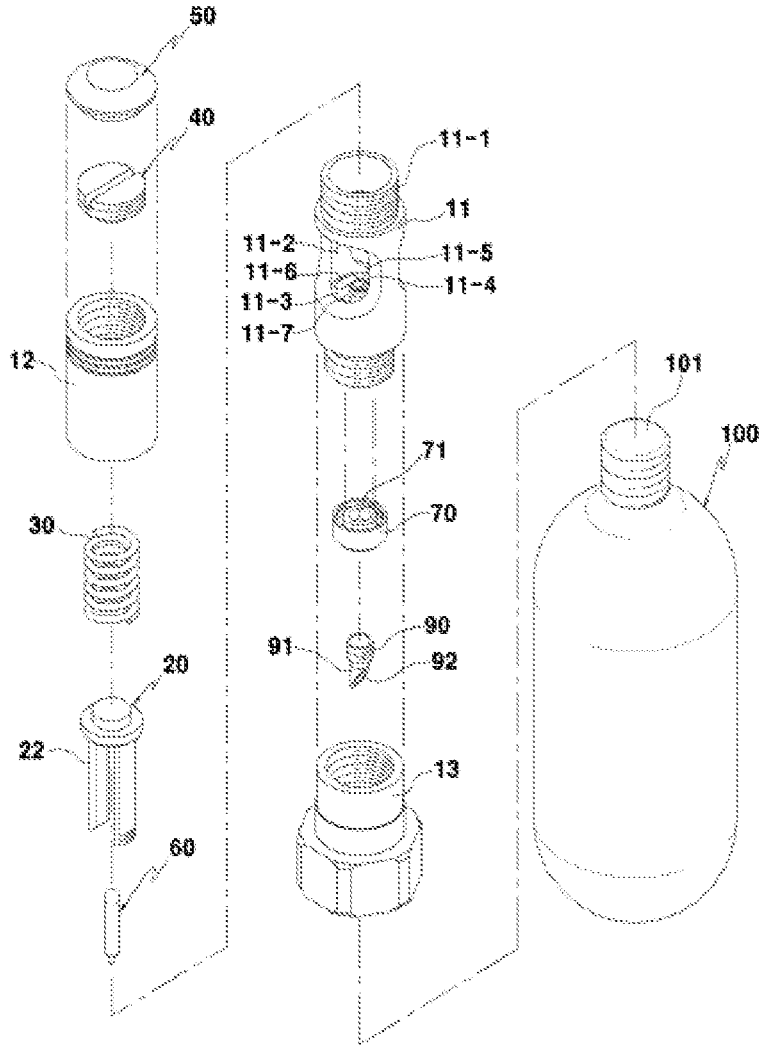

[FIG 8]
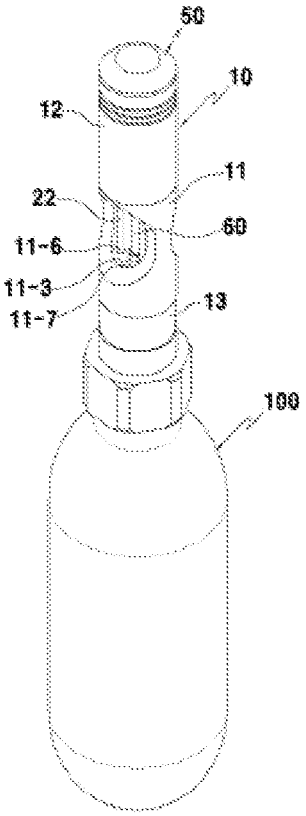

[FIG 9]
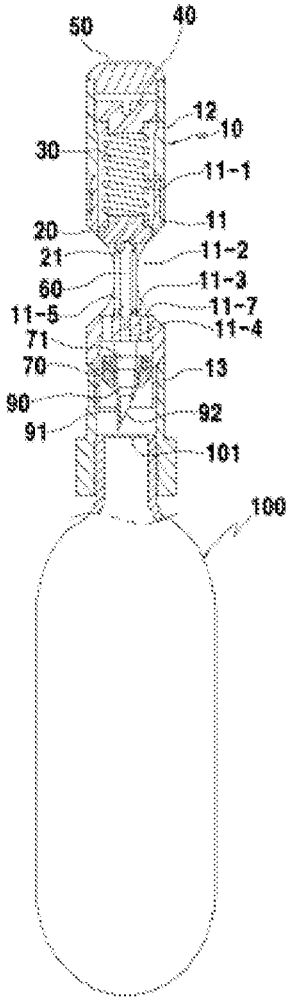

[FIG 10a]
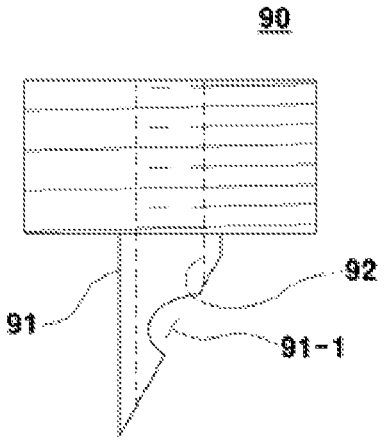
[FIG 10b]
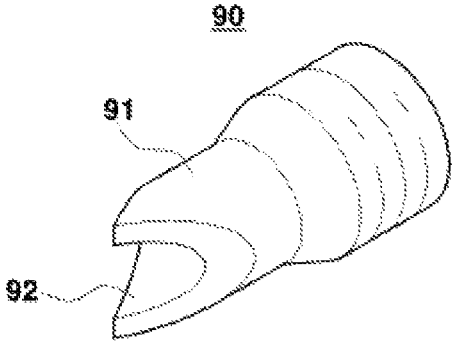

[FIG 11]
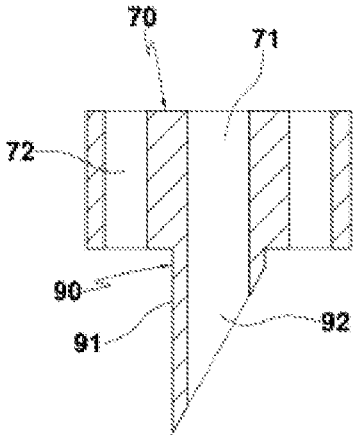

[FIG 12]
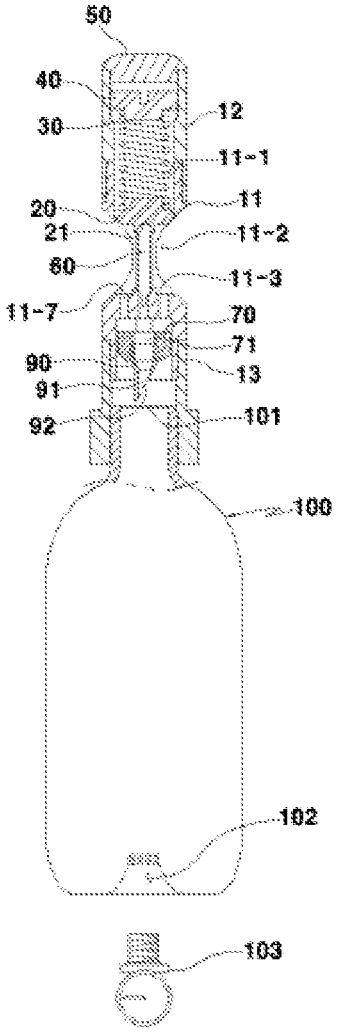

[FIG 13]
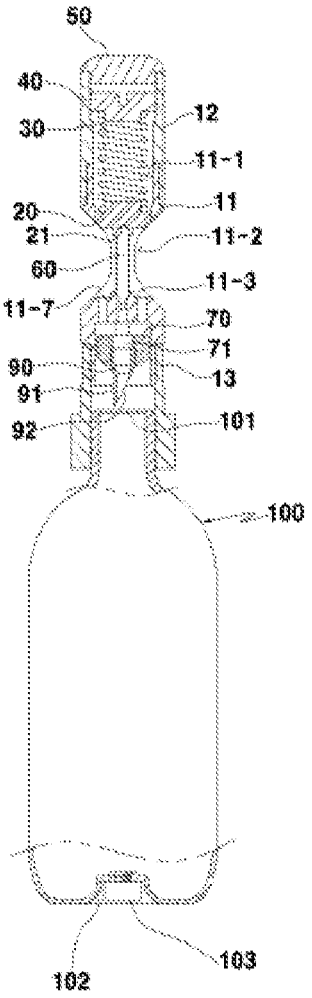

[FIG 14]
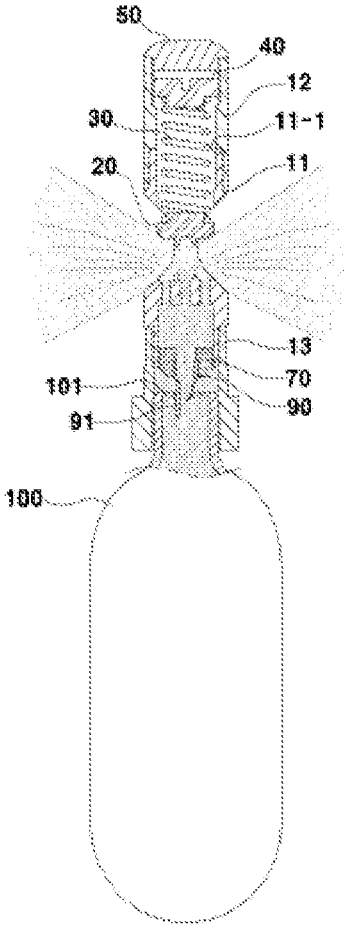

[FIG 15]
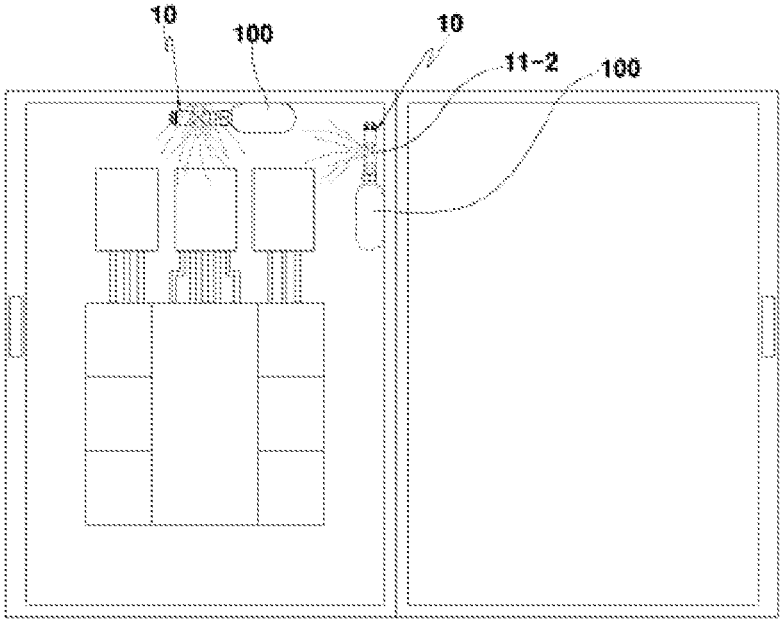

[FIG 16]
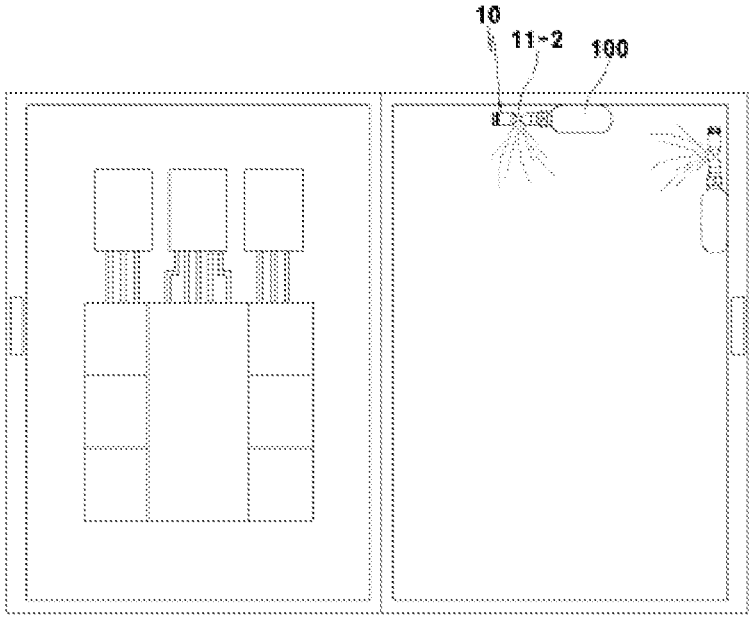

AUTOMATIC FIRE EXTINGUISHING SYSTEM FOR SMALL SPACES USING FIRE EXTINGUISHING AGENTS

TECHNICAL FIELD

This invention relates to an automatic fire extinguishing system for small spaces using fire extinguishing agents, more particularly to an automatic fire extinguishing system for small spaces using fire extinguishing agents in order to prevent a fire from spreading by having fire extinguishing agents pressured by a broken glass bulb from the heat strike the storage tank; dispersing fire extinguishing agents to a fire and then sealing the air.

DESCRIPTION OF THE RELATED ART

Generally, automatic fire distinguishers are designed to extinguish fire by using cooling and air-sealing effects of fire extinguishing agents in the beginning stage. It is miniaturized for prompt transportation.

There are many types depending on the fire extinguishing agents being used to automatic fire extinguishers or their mechanism. When classifying based on the fire extinguishing agents currently being used, the foam fire extinguisher, the powder fire extinguisher, the halon fire extinguisher and the carbon dioxide fire extinguisher are widely known.

Each type of fire distinguishers differ in use from others depending on the nature of a fire and the types of fire extinguishers can be categorized by ① the pump type water extinguisher, ② the acid-alkali extinguisher, ③ the foam extinguisher, ④ the carbon dioxide extinguisher, ⑤ the powder extinguisher, ⑥ the carbon tetrachloride extinguisher, ⑦ the CH2ClBr extinguisher, etc.

① The pump type water extinguisher is composed of a hand-maneuvered pump and a rubber hose affixed to the 16 L water container, which makes continuous water supply possible. Water can be shot effectively up to 8~12 m and it can be used for an infinite amount of time as far as water supply is not interrupted. It takes about 1 minute to discharge 16 L of water.

② Acid-Alkali Extinguisher: It is structured to mix dilute sulfuric acid and sodium bicarbonate, which generates carbon dioxide to have the liquid squirted by its pressure. Depending on the mixing method, it can be categorized by the breaking-bottle type and the overturn type. The dual-bottle type is mostly used nowadays, which is one of the break-bottle type systems. The dual-bottle type is comprised of the external bottle filled with water and the internal bottle with a double-wall filled with concentrated sulfuric acid and sodium bicarbonate powder. When in use, these substances shall be mixed by hitting the bump to break the double-wall. When putting the overturn-type fire extinguisher upside down, the lid stopping the sulfuric acid solution will be dropped and then the solution will be mixed. Water can be shot effectively up to 5~9 m and can be discharged in about 40 seconds.

③ The foam extinguisher typically has a similar structure of the overturn-type and the container is comprised of an internal bottle filled with the aluminum sulfate solution and an external bottle filled with the sodium bicarbonate aqueous solution. When in use, the container can be held upside down to open the internal bottle, which leads to generating carbon dioxide by the solutions being mixed together. With aluminum hydroxide being generated, carbon dioxide will bubble up and such foams can be sprayed by the pressure of the carbon dioxide. Foam can be effectively sprayed up to 5~9 m and can be discharged in about 40 seconds.

④ The carbon dioxide extinguisher is filled with liquefied carbon dioxide inside the container. When in use, the valve is opened to discharge carbon dioxide and dry ice. Due to its short discharge distance, it can be only used near the fire, thus cannot be used for a big flame. Carbon dioxide can be effectively sprayed up to 1~2.5 m and can be discharged in about 20 seconds.

⑤ The powder extinguisher is designed in a way that dry powders of sodium bicarbonate are put into the container and a small carbon dioxide Bombe is affixed to spray powders. When in use, the cap of the Bombe shall be broken to spray sodium bicarbonate powders through the nozzle by the carbon dioxide pressure, which will be dissolved by caloric heat to generate carbon dioxide. Powder can be effectively sprayed up to 3~6 m and can be discharged in about 15 seconds.

⑥ The carbon tetrachloride extinguisher utilizes the principle of latent heat of evaporation of carbon tetrachloride and its weight being heavier than air. Two thirds of the container is filled with carbon tetrachloride and air is injected (the pressure is approximately 7 kg/cm2) for the remaining space. Carbon tetrachloride can be effectively sprayed up to 5~9 m and can be discharged in about 40 seconds.

⑦ The container of the Bromochloromethane fire extinguisher is structured as a hand-lever type and methyl bromide is used as an extinguishing agent. Two thirds of the container is filled with methyl bromide and air is injected (the pressure is approximately 8~9 kg/cm2) for the remaining space. Methyl bromide can be effectively sprayed up to 3~6 m and can be discharged in about 20 seconds.

While being suitable for small fires, this prior art is for installing [an extinguisher] inside of electronic products or the container in which an electronic device is installed, wherein 'a ball needle operation device of the automatic diffusion fire extinguisher' published in the Korea Utility Model Gazette No. 1997-06853 (published on Jul. 9, 1997) combined a cylinder in the central top of the head connected with the fire extinguishing agent outlet through the central opening; an elevating bar with a ball needle was built in inside the cylinder for the spring to give elastic force; in order to affix the lower part of the elevating bar to the head with the thermal detector, a sensing substrate is composed with a central bolt, the nip balls holding both sides, a thermal lead and a tightening bolt having been inserted in order. The lower end of the elevating bar is to be screwed into the central bolt of such a sensing substrate to support the elevating bar.

In the said prior art, the sensing substrate is composed of a central bolt, the nip balls holding both sides, a thermal lead and a tightening bolt having been inserted in order. When the thermal lead is melted down by heat, the fire extinguisher will be in motion with the ball needle operated by the elevating bar. However, because the said thermal lead is located inside the sensing substrate, heat transfer was not properly performed in case of fire, which occasionally failed to have the thermal lead melt down. It became an issue as fire spread by failing to control it in the early stage.

PRIOR ART REFERENCE

Patent Reference (Patent Reference 0001) Korea Utility Model Gazette No. 1997-06853 (published on Jul. 9, 1997)

SUMMARY OF THE INVENTION

Technical Problem

The present invention is designed to resolve the said problem and its objective is to provide an automatic fire extinguishing device for small spaces using fire extinguishing agents in order to prevent a fire from spreading by spraying fire extinguishing agents to burning materials and sealing the air. This can be performed when a glass bulb is broken by heat from a fire, which leads to striking the tank storing pressurized fire extinguishing agents.

Technical Solution

As the means to accomplish the said objective, the present invention provides, an automatic fire extinguishing device for small spaces using fire extinguishing agents wherein the device can be installed in a small space in order to put out fires at an early stage by the glass bulb installed in the housing being broken by heat; the moving member is moved by the elastic body installed in the housing; the membrane of the tank storing pressurized fire extinguishing agents being damaged by the striking member connected with the moving member; and the fire extinguishing agents being spread, which were pressurized in a small space.

The automatic fire extinguishing device of the present invention further comprises: a housing with a hole and a support plate to transfer heat to the glass bulb with ease, which is penetrate [the housing] from one side to the other; a moving member fixing the glass bulb, which combined with the support plate of the housing; an elastic body combined with the moving member and installed in the housing in order to move the moving member in a certain direction; a tension adjusting member installed in one side of the elastic body and combined with the housing in order to adjust the elastic force of the elastic body; a cap combined with the housing; a glass bulb installed between the support plate of the housing and the moving member in order to be broken by heat; a fixing unit to be screwed to the moving member; a striking, member to be screwed to the fixing unit in order to have pressurized fire extinguishing agents dispersed by striking the entrance of the tank, which is caused by the movement of the moving member; a tank with pressured fire extinguishing agents to be installed in one side of the housing in order to discharge fire extinguishing agents by pressure in case of fire.

The housing of the present invention further comprises: a body with a hole formed to transfer heat to the glass bulb and a support plate where a moving member and a glass bulb are to be installed; a first connecting tube to be installed on one side of the body; a second connecting tube to be installed on the other side of the body where the first connecting tube is installed.

The moving member of the present invention further comprises: a moving member body where a fixing groove is placed in order to combine with the glass bulb; and a guiding bar to be installed in the moving member body in order to strike the opening of the tank by moving the striking member, which is caused by elastic force.

In the glass bulb of the present invention, one side is designed with a round shape and the other side is pointy. The said round-shaped area shall fit in the fixing groove to have it fixed inside [the groove] and the said pointy end with a curve shall fit in the curved surface of the main discharge hole to have it fixed inside [the main discharge hole].

The striking member of the present invention is inclined to one side at a certain angle in order to strike the membrane of the tank and its easier entry.

In the inclined area of the striking member of the present invention, it shall be easier to discharge the fire extinguishing agents through a horizontal groove, which are stored in the pressurized status in the tank.

In the striking member of the present invention, it shall be easier to strike and destroy the membrane of the tank by being inclined at a certain angle from the center of the bottom part towards the upper side.

The fixing unit and the striking member of the present invention are combined together and screwed to the moving member.

In the tank of the present invention, a gauge connecting hole can be found at the bottom part, wherein the pressure of the fire extinguishing agents are checked and displayed in a pressure gauge showing '-' or 'L'.

Effects of the Invention

The present invention has an effect on suppressing a fire in the early stage by dispersing the fire extinguishing agents pressurized in the tank. This shall occur when the glass bulb installed inside the housing is broken by the heat from a fire breaking out in a small space, which is susceptible to a fire such as distribution boxes, substation boxes, fridges, server racks, etc. The moving member is moved by the elastic force of the elastic body and the striking member destroys the membrane which blocks the opening of the tank.

BRIEF DESCRIPTION OF THE DRAWING

FIG. 1 is a perspective exploded view showing the composition of an automatic fire extinguishing system for small spaces using fire extinguishing agents according to the present invention.

FIG. 2 is an exploded perspective view showing the coupled composition of FIG. 1.

FIG. 3 is a cross-sectional diagram showing a coupled composition of FIG. 2.

FIG. 4 is an expanded block diagram showing the installed status of the glass bulb of the automatic fire extinguishing system for small spaces using the fire extinguishing agents according to the present invention.

FIG. 5 is an exploded perspective view showing another embodiment of the fixing unit of the automatic fire extinguishing system for small spaces using fire extinguishing agents according to the present invention.

FIG. 6 is a cross-sectional diagram showing a coupled status of FIG. 5.

FIG. 7 is an exploded perspective view showing another embodiment of the fire extinguishing system for small spaces using fire extinguishing agents according to the present invention.

FIG. 8 is a perspective view showing a coupled status of FIG. 7.

FIG. 9 is a cross-sectional diagram showing a coupled status of FIG. 8.

FIG. 10*a* is a drawing showing another embodiment of the striking member according to the present invention.

FIG. 10*b* is a block diagram showing another embodiment of FIG. 10*a*.

FIG. 11 is a cross-sectional diagram showing the fixing unit and the striking member combined together according to the present invention.

FIG. 12 is a drawing showing the pressure gauge to be installed in the tank of the automatic fire extinguishing system for small spaces using fire extinguishing agents according to the present invention.

FIG. 13 is a cut-away sectional diagram showing another embodiment of FIG. 12.

FIG. 14 is a cross-sectional diagram showing how an automatic fire extinguisher for small spaces works using fire extinguishing agents according to the present invention.

FIG. 15 is an exemplary view showing how an automatic fire extinguishing system for small spaces using fire extinguishing agents is installed inside the body of the panel board according to the present invention.

FIG. 16 is an exemplary view showing how an automatic fire extinguishing system for small spaces using fire extinguishing agents is installed on the door of the panel board according to the present invention.

DETAILED DESCRIPTION FOR CARRYING OUT THE INVENTION

Hereinafter, the automatic fire extinguishing system for small spaces using fire extinguishing agents according to the present invention will be described in the attached drawings.

The automatic fire extinguishing system for small spaces according to the present invention shall be roughly composed as shown in FIGS. 1 to 6 or in FIGS. 7 to 9 and shall be operated and installed as shown in FIGS. 13 to 15.

FIG. 1 is a perspective exploded view showing the composition of an automatic fire extinguishing system for small spaces using fire extinguishing agents according to the present invention; FIG. 2 is a exploded perspective view showing the coupled composition of FIG. 1; FIG. 3 is a cross-sectional diagram showing a coupled composition of FIG. 2; FIG. 4 is an expanded block diagram showing the installed status of the glass bulb of the automatic fire extinguishing system for small spaces using the fire extinguishing agents according to the present invention; FIG. 5 is an exploded perspective view showing another embodiment of the fixing unit of the automatic fire extinguishing system for small spaces using fire extinguishing agents according to the present invention; FIG. 6 is a cross-sectional diagram showing a coupled status of FIG. 5; FIG. 7 is an exploded perspective view showing another embodiment of the fire extinguishing system for small spaces using fire extinguishing agents according to the present invention; FIG. 8 is a perspective view showing a coupled status of FIG. 7; FIG. 9 is a cross-sectional diagram showing a coupled status of FIG. 8; FIG. 10*a* is a drawing showing another embodiment of the striking member according to the present invention; FIG. 10*b* is a block diagram showing another embodiment of FIG. 10*b*; FIG. 11 is a cross-sectional diagram showing the fixing unit and the striking member combined together according to the present invention; FIG. 12 is a drawing showing the pressure gauge to be installed in the tank of the automatic fire extinguishing system for small spaces using fire extinguishing agents according to the present invention; FIG. 13 is a cut-away sectional diagram showing another embodiment of FIG. 12; FIG. 14 is a cross-sectional diagram showing how an automatic fire extinguishing for small spaces works using fire extinguishing agents according to the present invention; FIG. 15 is an exemplary view showing how an automatic fire extinguishing system for small spaces using fire extinguishing agents is installed inside the body of the panel board according to the present invention; FIG. 16 is an exemplary view showing how an automatic fire extinguishing system for small spaces using fire extinguishing agents is installed on the door of the panel board according to the present invention.

Referring to FIGS. 1 to 6, the present invention is an automatic fire extinguishing system to be installed in a small space in order to suppress a fire at an early stage, wherein the moving member (20) is moved by the elastic body installed in the housing (10) when the glass bulb (60) is destroyed by the heat of a fire, which is installed in the housing (10); the fire extinguishing agents destroy the membrane (101) of the tank (100) storing the pressurized fire extinguishing agents in a small space with the striking member (90) combined with the moving member (20).

The said automatic fire extinguishing system includes a housing (10), a moving member (20), an elastic body (30), a tension adjusting member (40), a cap (50), a glass bulb (60), a fixing unit (70), a striking member (90) and a tank (100).

The said housing (10) is comprised of a connecting hole (11-2) formed to transfer heat to the glass bulb (60) and to disperse the pressurized fire extinguishing agents; a body (11) of which a moving member (20) and a glass bulb (60) are to be installed on a support plate (11-3); a first connecting tube (12) to be installed on one side of the said body (11); and a second connecting tube (13) to be installed on the other side of the said body (11) where the first connecting tube (12) is installed.

In addition, a connecting tube (11-1) is screwed to the upper part and the lower part of the said body (11) respectively, which is connected to the first connecting tube (12) and the second connecting tube (13).

The said connecting hole (11-2) is formed in an oval shape on both sides of the body (11). In order to make it easier to disperse fire extinguishing agents, the connecting holes (11-2) shell be leaned on one side at a certain angle towards the body (11) so as to diffuse the fire extinguishing agents dispersed through the connecting hole (11-2).

The said support plate (11-3) is affixed to the inside of the body (11), which includes an insertion hole (11-6) to be combined with the moving member (20) and the main discharge hole to discharge fire extinguishing agents (11-4). The said main discharge hole (11-4) is to be combined with a glass bulb (60) which will be described below.

In the main discharge hole (11-4), a curved surface (11-5) is formed to fit with the curved area which ends the pointy tip of the glass bulb (60) so as to have the glass bulb fixed in a stable way.

In addition, a plural number of the sub discharge hole (11-7) shall be formed among the said insertion holes (11-6) in order to discharge fire extinguishing agents. The fire extinguishing agents shall be discharged through the said sub discharge hole (11-7) and the main discharge hole (11-4) and dispersed through the connecting hole (11-2) with ease.

The said first connecting tube (12) is oval-shaped and shall be screwed to the lower part of the inside in order to combine with the connecting tube (11-1) of the body (11). Furthermore, a tension adjusting member (40) is screwed to the upper part of the inside of the first connecting tube (12) to be able to adjust the elastic force.

The said second connecting tube (13) is oval-shaped and shall be screwed to the upper part and the lower part in order to combine with the connecting tube (11-1) of the body (11) and the tank (100) Nuts can be screwed in the outer circumference of the oval shape so as to combine the tank (100) with a tool.

The said moving member (20) shall have a fixing groove (22) in order to combine with the glass bulb (60). In order to combine with the elastic body (30), the following objects will be installed: a moving member body (21) of which overall shape looks like '⊥'; and a plural number of guiding bars (23) to be installed on one side of the said moving member body (21) in a semi-circle shape.

As shown in the Figure, the said fixing groove (22) shall have the same shape as the end tip of the glass bulb (60). In addition, the end tip of the glass bulb (60) shall be supported by the rounded edge.

The inside of the end tip of the said guiding bar (23) is to be screwed with a bolt (80). The said guiding bar (23) shall be combined with the insertion hole (11-6) which can be found on the support plate (11-3) of the body (11).

As illustrated in FIGS. 1 to 4, the said guiding bar (23) is composed of a plural number of bars. There is a plural number of semi-circle shapes as illustrated in FIG. 5.

That is, the said guiding bar (23) shall not be limited to a certain composition and may be composed in various forms. As far as the moving member (20) can be moved with ease by the said elastic body (20), it can be composed regardless of its form.

The said elastic body (30) is combined with one side of the moving member body (21) of the said moving member (20) and is installed inside the first connecting tube (12) of the housing (10). The elastic force of the said elastic body (30) can be adjusted by the tension adjusting member (40).

The said tension adjusting member (40) shall be combined with one side of the elastic body (30) and to be screwed to the inside of the first connecting tube (12) of the housing (10). A groove (no sign) is placed on one side of the said tension adjusting member (40) to be able to accommodate a flat-head screwdriver. When a flat-head screwdriver is used for the said groove, the location of the tension adjusting member (40) can be adjusted so as to control the elastic force of the elastic body (30).

The said cap (50) is combined with one side of the first connecting tube (12) of the housing (10) to prevent foreign substances from being brought into the inside of the first connecting tube (12). A manufacturer label shall be affixed to the said cap (50) or affixed to the inside of the groove formed on one side.

Each side of the said glass bulb (60) shall be fixed to the main discharge hole (11-4) of the support plate (11-3) of the housing (10) and the fixing groove (22) of the moving member (20) respectively in order to be broken by heat in case of a fire, which shall be located in the connecting hole (11-2) formed in the body (11) of the housing (10).

As illustrated in FIG. 4, one side of the said glass bulb (60) shall be round-shaped and the other side shall be pointy. The rounded area of the said moving member (20) will be contacted with and affixed to the inner surface.

In addition, as illustrated in the figure, the pointy area of the glass bulb (60) will be contacted with and affixed to the curved surface (11-5) of the main discharge hole (11-4) in the shoulder area of the glass bulb (60), that is the round surface connecting the pointy area to the body.

The said fixing unit (70) is round-shaped wherein an agent discharge hole (71) to be screwed with the striking member (90) is formed to discharge fire extinguishing agents and a plural number of connecting holes (72) are formed to be bolted (80) to the outer circumference of the said agent discharge hole (71).

The said striking member (90) has a screw connection (93) to be screwed with the agent discharge hole (71) of the fixing unit (70) and a striking protrusion (91) inclined at a certain angle is formed. In the said striking protrusion (91), an agent inlet (92) is formed where fire extinguishing agents are discharged in order to disperse the fire extinguishing agents through the connecting hole (11-2) of the body (11).

In the said tank (100), fire extinguishing agents are pressurized and stored in order to be dispersed in the route of the agent inlet (92) of the striking member (90), the agent discharge hole (71) of the fixing unit (70) and the main discharge hole (11-4) of the body (11-2) in case of a fire.

In the said tank (100), fire extinguishing agents are pressurized and stored with a membrane (101) at the opening. The said tank (100) is to be screwed to the second connecting tube (13) of the housing (10).

Pentafluoroethan (HFC-125), Hexafluoropropane (HFC-227ea), Novec 1230 (NOVEC-1230), etc. are used for the fire extinguishing agents stored in the said tank (100).

In addition, cold-rolled steel pipes and steel tapes are to be used for the said tank (100) in order to sustain its pressure because fire extinguishing agents are pressurized and stored in the tank.

The automatic fire extinguishing system for small spaces using fire extinguishing agents according to the present invention doesn't have to be limited to the composition illustrated in FIG. 1. It can be carried out in a different way as shown in FIG. 7 to FIG. 9.

Referring to FIG. 7 to FIG. 9, the automatic fire extinguishing system for small spaces using fire extinguishing agents according to the present invention includes a housing (10), a moving member (20), an elastic body (30), a tension adjusting member (40), a cap (50), a glass bulb (60), a fixing unit (70), a striking member (90) and a tank (100).

Since the compositions of the said moving member (20), the elastic body (30), the tension adjusting member (40), the cap (50), the glass bulb (60), the fixing unit (70), the striking member (90) and the tank (100) are the same as the ones illustrated in FIG. 1 to FIG. 6, the description thereof is omitted.

However, the description of the housing (10) of which composition is different from the ones shown in FIG. 1 to FIG. 6 will be provided.

[It is] comprised of a body (11) with a connecting hole (11-2) of the said housing (10) and a support plate (11-3), a first connecting tube (12) to be installed on one side of the said body. (11) and a second connecting tube (13) to be installed on the other side of the first connecting tube (12).

Furthermore, one side of the said first connecting tube (12) shall remain open to support the elastic body inside while the other side shall be blocked.

When one side of the first connecting tube (12) is blocked as described above, a longer elastic body (30) in length may be applied. Thus, the striking member (90) moved by the elastic body (30) should be able to destroy the membrane (101) of the tank (100) with ease, which leads to an easier discharge of the fire extinguishing agents pressurized and stored inside.

In addition, the said fixing unit (70) and the striking member (90) don't have to be limited by the illustrated figure and may be composed of as illustrated in FIGS. 10 and 11.

The fixing unit (70) and the striking member (90) are shown in FIG. 10. Having the striking member (90) affixed to the lower part of the fixing unit (70) to strike the membrane of the tank (100), it can hold up firmly against the elastic force from the elastic body (30). That is, it prevents separation or distortion from occurring.

In addition, the fixing unit (70) and the striking member (90) are combined together, which prevents not only the fire extinguishing agents which are pressurized and stored inside the tank (100) from being spread around but also strong pressure shall be applied to the agent inlet (92) of the striking member (90) in order to discharge a large amount of fire extinguishing agents at once. Thus, a wide array of dispersion through the connecting hole (11-2) makes it easier to suppress a fire at an early stage.

The striking protrusion (91) of the said striking member (90) has a horizontal groove (91-1) in a "כ" shape in the inclined area. When striking the membrane, it prevents the agent inlet (92) from being blocked by the broken membrane (101), which makes it easier to discharge pressurized fire extinguishing agents.

Furthermore, as the said striking member (90) and the striking protrusion (91) being illustrated in the figure, it doesn't have to be limited to be inclined to one direction so as to strike the membrane (101) of the tank (100) for an easier entry. It may be composed of in different ways.

The striking member (90) of the present invention doesn't have to be limited to FIG. 10*a* and may be carried out in a different way as shown in FIG. 10*b*. Referring to FIG. 10*b*, the striking member (90) of the present invention is cut diagonally from both sides of the round-shaped striking protrusion (91) downwards to the center to form a pointy end of the striking protrusion (91). In order to have the fire extinguishing agents flow into the pointy striking protrusion (91), the agent inlet (92) shall be expanded.

When the said striking protrusion (91) brakes the membrane (101) placed at the opening of the tank (100) and then gets to the inside, the fire extinguishing agents pressurized and stored in the tank (100) flow in through the agent inlet (92) and are dispersed through the connecting hole (11-2) placed in the body (11), which makes it possible to suppress a fire at an early stage.

Referring to FIG. 11, the striking protrusion (91) of the striking member (90) of the present invention forms a incline at a certain angle from both sides of the upper part downwards to the center. When striking the membrane (101) of the tank (100), it will make it easier to get to the inside.

As described above, since the striking protrusion is cut diagonally from both sides downwards to the centre, not only is it easy to break the membrane (101) when striking but it can be prevented to block the agent inlet (92) with the broken membrane (101) at the time of striking.

In addition, the said striking member (90) doesn't have to be limited by the composition illustrated in FIG. 6*b*. Various ways are available, that is composing the striking protrusion (91) in a cylindrical shape and making the lower part of the striking protrusion (91) serrated in order to discharge the pressurized fire extinguishing agents to the agent inlet (92) with ease as well as preventing the agent inlet (92) from being blocked by the broken membrane (101) when striking the membrane of the tank (100).

In addition, while it is not shown in the figures, the lower part of the said striking member (90) shall be serrated, a plural number of agent inlet (92) shall be placed in the gimlet-shaped area to make it easier to strike the membrane (101). At the same time, the striking member (90) gets to the inside of the tank (100) so that the pressurized fire extinguishing agents can be discharged to the agent inlet (92) with ease.

Furthermore, the said tank (100) can be composed of differently from what is shown in FIG. 12.

Referring to FIG. 12, a gauge connecting hole (102) is formed at the bottom of the said tank (100) and the pressure gauge (103) is installed at the said gauge connecting hole (102) in order to check the pressure status of the fire extinguishing agents pressurized and stored inside the tank (100).

The said pressure gauge (103) is formed in a '-' shape or a 'L' shape depending on the status of the space where the automatic fire extinguishing system for small spaces using fire extinguishing agents.

With the said pressure gauge (103) installed, the inside pressure of the tank (100) can be constantly checked. When a fire breaks out, it prevents a failure of discharging fire extinguishing agents due to low pressure in advance, which makes it easier to suppress a fire at an early stage.

The composition of the tank according to the present invention doesn't have to be limited by FIG. 12. It may be carried out in a different way as shown in FIG. 13.

Referring to FIG. 13, the gauge connecting hole (12) is placed at the bottom of the tank (100) at a multilevel. A pressure gauge (103) shall be installed in the multilevel gauge connecting hole (102) in order to check the pressure status of the fire extinguishing agents pressurized and stored inside the tank (100).

The pressure gauge (103) installed at the bottom of the said tank (100) shall be designed to be inserted into the gauge connecting hole (102) so as not to be interrupted by the pressure gauge (103) when the tank (100) is placed on the ground or table.

The automatic fire extinguishing system for small spaces using fire extinguishing agents according to the present invention as described above can be installed in a small space including distribution boxes, substation boxes, refrigerators, server racks, etc. as shown in FIGS. 14 to 16 in order to suppress a fire at an early stage.

FIGS. 14 to 16 illustrate the status wherein an automatic fire extinguishing system for small spaces using fire extinguishing agents according to the present invention is installed in a housing or a body of a distribution box but not limited thereto.

Referring to FIGS. 14 to 16, the process of dispersing fire extinguishing agents will be described in case of a fire.

Referring to FIGS. 14 to 16, the automatic fire extinguishing system for small spaces using fire extinguishing agents according to the present invention can be installed on either the upper inner side of the distribution box or on one of the internal surfaces or one each on the upper side or inside respectively.

When a fire breaks out at the status described above, the glass bulb (60) installed between the moving member (20) and the support plate (11-3) of the body (11) will be broken by heat.

When the said glass bulb (60) is broken, it will be sent to the direction where the tank (100) is installed to move the moving member (20) since the elastic body (30) installed in the first connecting tube (12) of the housing (10) is supported by the tension adjusting member (40).

The said moving member (20) is guided by the insertion hole (11-6) formed on the support plate (11-3) of the body (11); moves the striking member (90) installed on the fixing unit (70); and destroy the membrane (101) blocking the opening of the tank (100).

When the said striking member (90) breaks the membrane and enters inside the opening of the tank, pressurized fire extinguishing agents are discharged with a route of the agent inlet of the striking member, the agent discharge hole of the fixing unit and the main discharge hole.

At this time, the dispersed fire extinguishing agents are discharged through the main discharge hole (11-4) and bumped into the lower part of the moving member (20). They are dispersed, spread and discharged through the main discharge hole (11-4) at the same time. Since fire extinguishing agents are spread in various angles, a fire which breaks out in a small space can be promptly suppressed.

As described above, the automatic fire extinguishing system for small spaces using fire extinguishing agents according to the present invention can prevent a fire from being spread because it is easy to suppress a fire at an early stage with fire extinguishing agents which promptly spread.

In the detailed description of the present invention described above, the preferred embodiment of the present invention were referred to but the claims of the present invention are not limited to the said embodiments. Those of ordinary skill in the art will understand that the present invention may be revised or modified in various ways within the range not exceeding the concept and the technical field of the present invention.

DESCRIPTION OF SIGNS

| | |
|---|---|
| 10: Housing | 11: Body |
| 11-1: Connecting Tube | 11-2: Connecting Hole |
| 11-3: Support Plate | 11-4: Main Discharge Hole |
| 11-5: Curved Surface | 11-6: Insertion Hole |
| 11-7: Sub Discharge Hole | 12: First Connecting Tube |
| 13: Second Connecting Tube | 20: Moving Member |
| 21: Moving member Body | 22: Fixing Groove |
| 23: Guiding Bar | 30: Elastic Body |
| 40: Tension Adjusting Member | 50: Cap |
| 60: Glass Bulb | 70: Fixing Unit |
| 71: Agent Discharge Hole | 72: Connecting Hole |
| 80: Bolt | 90: Striking Member |
| 91: Striking Protrusion | 91-1: Horizontal Groove |
| 92: Agent Inlet | 100: Tank |
| 101: Membrane | 102: Gauge Connecting Hole |
| 104: Pressure Gauge | |

What is claimed:

1. An automatic fire extinguishing system, comprising:

a tank that contains fire extinguishing agents, the tank having an opening with a membrane sealing the opening; and a housing having:

a body that has opposite first and second ends, and a side connecting hole in the body, and with a support plate provided inside the body, the support plate having a discharge hole and at least one insertion hole;

a first connecting tube connected to the first end of the body;

a second connecting tube connected to the second end of the body and to the tank adjacent the opening of the tank; and a glass bulb retained inside the body in a manner where the glass bulb is exposed by the side connecting hole and is supported on the support plate with one end of the glass bulb fitted into the discharge hole;

a moving member positioned inside the first connecting tube, the moving member having a body with a plurality of guiding bars extending therefrom and with each guiding bar extending through one of the insertion holes, and the moving member also having a fixing groove which retains a portion of the glass bulb such that the glass bulb is installed between the support plate and the body of the moving member;

an elastic body positioned inside the first connecting tube and positioned against the moving member to normally bias the moving member against the glass bulb;

a fixing member positioned inside the second connecting tube, and having a striking member that includes a striking protrusion that is normally positioned spaced apart from the membrane; and wherein when heat is transferred via the side connecting hole to the glass bulb to break the glass bulb, the elastic body biases the moving member to cause the guiding bars to push the striking member so that the striking protrusion pierces the membrane.

2. The system of claim 1, further including:

a cap provided at an upper end of the first connecting tube, and a tension adjusting member positioned between the cap and the elastic body.

3. The system of claim 1, wherein:

the glass bulb has a pointed end that is fitted with the discharge hole, and a round-shaped end that is fitted inside the fixing groove.

4. The system of claim 1, wherein:

the striking member has a diagonally cut surface that is inclined to a one side at a certain angle in order to strike the membrane of the tank and with greater ease.

5. The system of claim 4, wherein the diagonally cut surface of the striking member has a horizontal groove that allows the fire extinguishing agents to be discharged with ease.

6. The system of claim 1, wherein the fixing unit and the striking member are integrated together to be screwed to and combined with the moving member.

7. The system of claim 1, wherein a gauge connecting hole is formed in the tank, and a pressure gauge is composed in a '-' shape or a shape in order to check and display the pressure of the fire extinguishing agents in the gauge connecting hole.

* * * * *